US006290143B1

(12) United States Patent
Vincent et al.

(10) Patent No.: US 6,290,143 B1
(45) Date of Patent: Sep. 18, 2001

(54) APPARATUS AND METHOD FOR COLLECTING LIQUID SPILLAGE AT RAIL FACILITIES

(75) Inventors: Jon R. Vincent, Lake Charles; Richard C. Gaudet, Sulphur, both of LA (US)

(73) Assignee: Century Group, L.L.C., Sulphur, LA (US)

( * ) Notice: Subject to any disclaimer, the term of this patent is extended or adjusted under 35 U.S.C. 154(b) by 0 days.

(21) Appl. No.: 09/440,912

(22) Filed: Nov. 16, 1999

Related U.S. Application Data

(63) Continuation-in-part of application No. 09/059,748, filed on Apr. 14, 1998, now abandoned, which is a continuation-in-part of application No. 08/643,014, filed on May 2, 1996, now Pat. No. 5,782,405.

(51) Int. Cl.[7] ..... B65D 1/00
(52) U.S. Cl. ..... 238/2; 220/573
(58) Field of Search ..... 238/2–9; 104/133; 220/571, 573; 137/312, 313; 141/86, 88

(56) References Cited

U.S. PATENT DOCUMENTS

| | | | | |
|---|---|---|---|---|
| 1,408,134 | | 2/1922 | O'Donnell . | |
| 3,773,255 | | 11/1973 | Schoulties et al. . | |
| 4,010,896 | | 3/1977 | Stockton . | |
| 4,296,884 | | 10/1981 | Luebke . | |
| 4,299,697 | | 11/1981 | Curati, Jr. . | |
| 4,300,721 | * | 11/1981 | Rich | 238/2 |
| 4,311,273 | | 1/1982 | Marsh . | |
| 4,366,846 | | 1/1983 | Curati, Jr. . | |
| 4,388,357 | | 6/1983 | Luebke . | |
| 4,406,403 | | 9/1983 | Luebke . | |
| 4,651,887 | * | 3/1987 | Patrick | 220/571 |
| 5,435,458 | * | 7/1995 | Bishop | 220/573 |
| 5,492,158 | | 2/1996 | Haag . | |
| 5,775,869 | * | 7/1998 | Bishop | 137/312 |
| 5,782,405 | | 7/1998 | Vincent . | |
| 6,173,856 | * | 1/2001 | Bierce et al. | 220/573 |

FOREIGN PATENT DOCUMENTS

| | | |
|---|---|---|
| 40087477A1 | 9/1991 | (DE) . |
| 0 539 349 A | 4/1993 | (EP) . |
| 0 539 349 A1 | 7/1997 | (EP) . |
| 09522533A1 | 10/1999 | (EP) . |

OTHER PUBLICATIONS

European Search Report, Aug. 9, 1999.
European Search Report, Mar. 8, 2001.

* cited by examiner

*Primary Examiner*—Mark T. Le
(74) *Attorney, Agent, or Firm*—Bracewell & Patterson L

(57) ABSTRACT

An apparatus and method for collecting liquid spillage at rail facilities including the plurality of center pans (10) and side pans (14) arranged in end to end relation. The pans (10, 14) are formed of a plastic material, preferably high density polyethylene. Each pan (10, 14) has a vertical drain pipe (54, 78) which fits within an elastomeric sleeve (60) about an upper drain opening (34) in a transverse drain conduit (28) positioned between a pair of crossties beneath the pans (10, 14). Each center pan (10) has a resilient upwardly inclined side flange or lip (44). For installation, the center pan (10) is preferably installed by first inserting one resilient side flange (44) beneath the head (16) of an adjacent rail (12) and then lowering the bottom (40) of the pan (10) onto the upper surface of the crossties (24) with drain pipe (54) received in sealing relation within the aligned elastomeric seal (60). Then, the opposed side flange (44) supported on the upper surface of the head (16) is forced or pushed downwardly beneath the head (16) where it snaps into sealing relation generally at the juncture of the vertical web (18) and the head (16) of the rail (12). Removable covers 90, 104, and 90A, are provided for covering center pans (10) and side pans (14).

32 Claims, 6 Drawing Sheets

APPARATUS AND METHOD FOR COLLECTING LIQUID SPILLAGE AT RAIL FACILITIES

REFERENCE TO RELATED APPLICATION

This application is a continuation in part of application Ser. No. 09/059,748 filed Apr. 14, 1998 entitled "Flexible Center Drain Pan For Railroad Track", now abandoned; which is a continuation in part of application Ser. No. 08/643,014 filed May 2, 1996 entitled "Railroad Track Collector Pan System", now U.S. Pat. No. 5,782,405 dated Jul. 21, 1998.

FIELD OF THE INVENTION

This invention relates to a system for collecting liquid spillage inadvertently spilled along a railroad track primarily from the filling or emptying of railway tank cars or the fueling of locomotives.

BACKGROUND OF THE INVENTION

The system includes a plurality of center pans and side pans supported on the crossties of the railway track for the draining of any liquid spillage from the pans into an enclosed transverse drain conduit positioned between a pair of crossties beneath the rails for flow into a collection container. Heretofore, a pan collection structure for a railway track has been provided utilizing center pans between the rails and side pans outside the rails. The pans heretofore have been supported on crossties and drain into a transverse drain conduit positioned between a pair of crossties beneath the pans.

For example, U.S. Pat. No. 4,300,721 dated Nov. 17, 1981 shows a system for collecting liquid spillage having a plurality of center pans and side pans. Vertical drain conduits extend from the pans into an enclosed transverse drain conduit for drainage. The transverse drain conduit empties into a collection receptacle. While the pans are formed of a molded plastic material, separate vertical drains are connected to the bottom of the pans. Further, while side edges of the pans are positioned adjacent the vertical web of the rails, a separate caulking material is used to provide sealing against the rails. The rigid vertical drain conduits are threaded into openings in the pans and in the enclosed transverse drain conduit.

U.S. Pat. No. 5,435,458 dated Jul. 25, 1995 shows a spill containment device for railroads in which slidable covers are positioned over center pans for closing the center pans when not required to be open to contain a potential spill. Foldable hinged panels are utilized for closing the outer field pans.

It is desired that a closed system for the collection of liquid spillage on a railroad track be provided that may be installed in a minimum of time with sealing against the rails.

SUMMARY OF THE INVENTION

The present invention is directed to a system for collecting spillage on a railway track including the apparatus or structure positioned on the crossties beneath railway cars and the method for installing such a collection structure between the rails and outwardly of the rails. The collection structure includes a plurality of center and side pans molded to shape from a resilient plastic material, such as high density polyethylene. The resilient center pans between rails have a pair of upwardly extending inclined side flanges which fit beneath the heads of the rails in sealing relation with the rails without any additional sealing members. A downwardly extending tubular drain pipe is molded onto each pan and fits within an enclosed transverse drain conduit positioned between a pair of crossties beneath the rails. The transverse drain conduit has an upper opening receiving each vertical drain pipe and a resilient annular seal about the upper opening receives the vertical drain pipe to provide a resilient sealing relation and to position the pans accurately.

The outer ends of the pans in one transverse row have outwardly extending end flanges which lap end flanges on an adjacent transverse row of pans arranged in end to end relation. Fasteners connect the lapping end flanges of adjacent transverse rows together to permit limited relative longitudinal movement which may result from temperature expansion or contraction, for example.

The pans forming this invention may be installed and assembled in a minimum of time. A preferred assembly method includes the insertion of center pans between rails with one resilient side flange positioned beneath the rail against the vertical web of the rail under the head of the rail with the pan being inclined upwardly from the rail. The inclined pan is then pivoted downwardly with the bottom of the center pan resting against the crossties and the opposite resilient side flange in contact relation with the upper surface of the rail. Next, the opposite resilient side flange is forced by a suitable tool downwardly beneath the head of the rail where it snaps outwardly against the vertical web of the rail in sealing relation thereto. A downwardly extending integral drain pipe molded on each of the pans is vertically aligned with the lower receiving opening in the transverse drain conduit for initial positioning of the center pan accurately with the transverse drain conduit. An annular resilient seal is positioned within the opening of the drain conduit to receive the vertical drain pipe in sealing relation.

In some instances, it may be desirable to position the center pan on the crossties with the bottom of the center pan supported on the crossties and both of the resilient side flanges in engagement with the upper surface of the rails. Then, each of the resilient side flanges may be forced or pushed beneath the head of the adjacent rail for snapping beneath the head of the adjacent rail in sealing relation with the vertical web of the rail.

Each of the side pans has a resilient side flange in sealing relation with the vertical web of the adjacent rail. Fasteners are provided to secure the side pans to the crossties and to permit limited expansion and contraction thereof. Ballast on an outwardly extending lower flange or foot of the side flange assists in maintaining the side pan in sealing relation against the rail.

One embodiment of the invention provides removable covers for closing the center and field pans when the pans are not required to be open to contain a potential spill. The center cover has opposed side flanges which provide longitudinal flow channels and also fit beneath the heads of the adjacent rails. Another embodiment of the invention provides removable covers for pans including side flanges which provide longitudinal flow channels and have spouts for the drainage of fluids from the flow channels. Slidable covers without spouts are also provided for opening of the pans.

Other features and advantages of the invention will be apparent from the following specification and drawings.

DESCRIPTION OF THE INVENTION

Figure 1:
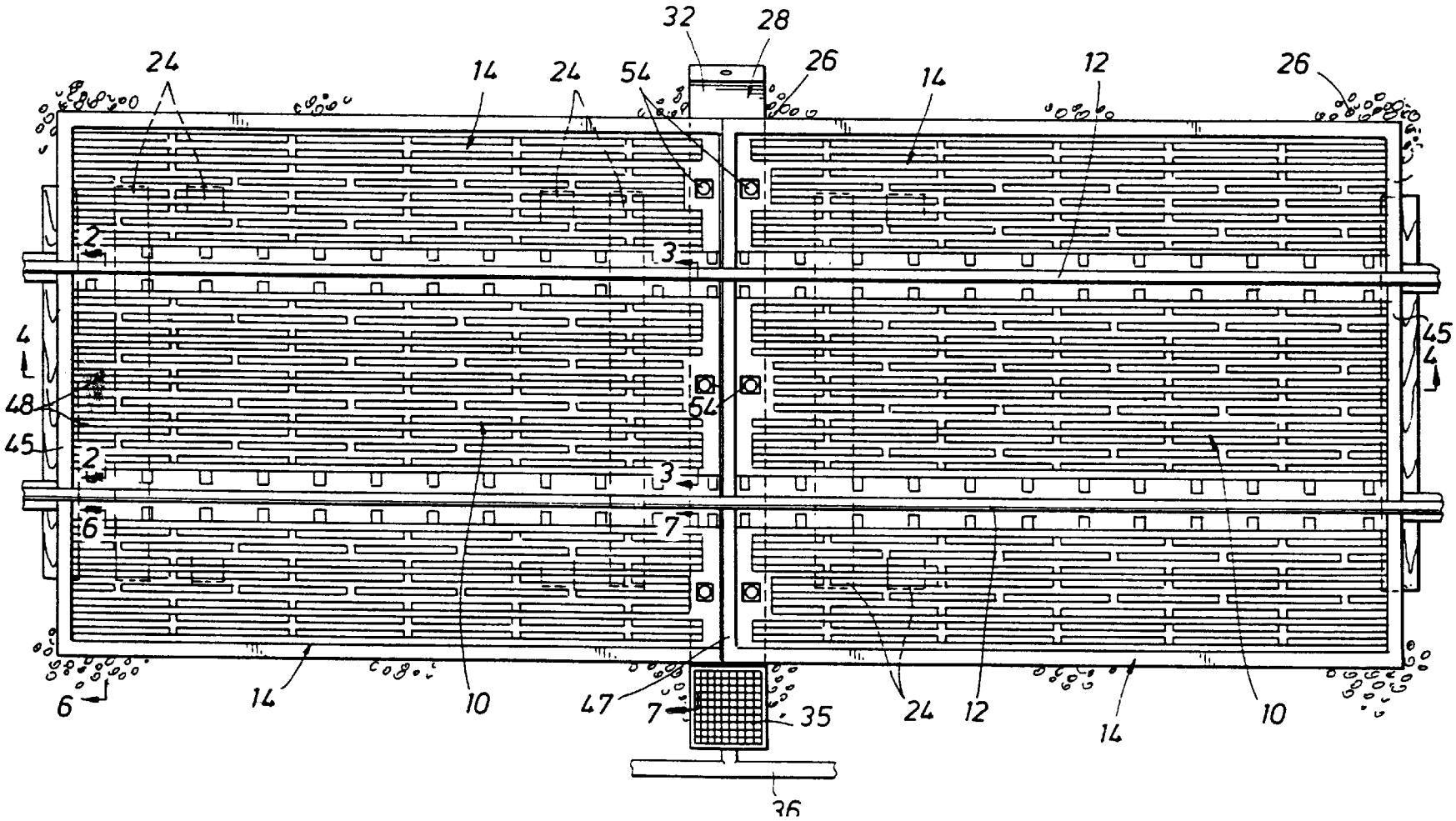
FIG. 1 is a plan view of a pan system including two rows of molded plastic pans in accordance with the present invention positioned on a railway track for collecting spillage from tank cars and locomotives, each row including a center pan between the rails a pair of side pans outside the rails.

The present invention is directed to a pan system for collecting liquid spillage on a railroad track. As shown particularly in FIG. 1, two adjacent transverse rows of drain pans are shown including a pair of center pans generally indicated at 10 arranged in an end to end relation between rails 12 of the railroad track and a pair of side pans generally indicated at 14 arranged in end to end relation along the outer side of each rail 12. Each rail 12 as shown particularly in FIGS. 2 and 3 includes an upper head or ball 16, a vertical web 18, and a lower base 20. Lower base 20 is mounted on tie plates 22 supported on crossties 24. Crossties 24 are mounted on ballast 26 normally comprising crushed rock.

Figure 5:
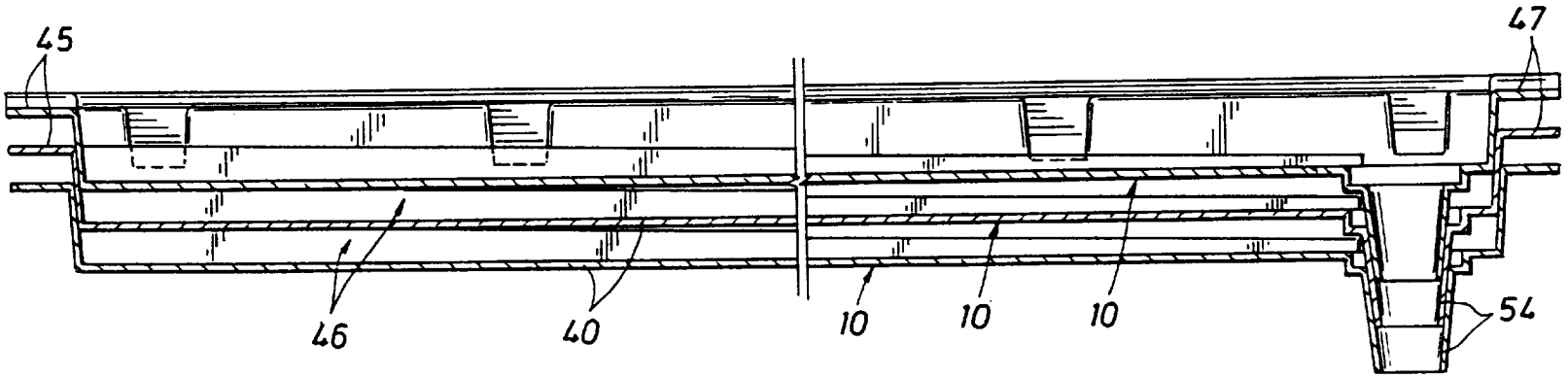
FIG. 5 is a longitudinal sectional view of a plurality of center pans shown in a vertically stacked for storage or transport.

Pans 10 and 14 are formed of a molded lightweight plastic material, preferably high density polyethylene, having a thickness of preferably about ¼ inch to provide flexibility and resilience. Pans 10 and 14 formed of a lightweight material may be easily stacked vertically for storage or transport prior to installation on a railroad track such as shown in FIG. 5 for center pans 10. Also, relatively long length pans such as fifteen (15) feet in length, function in a satisfactory manner. Thus, each row shown in FIG. 1 may have a length of fifteen (15) feet.

Figure 3:
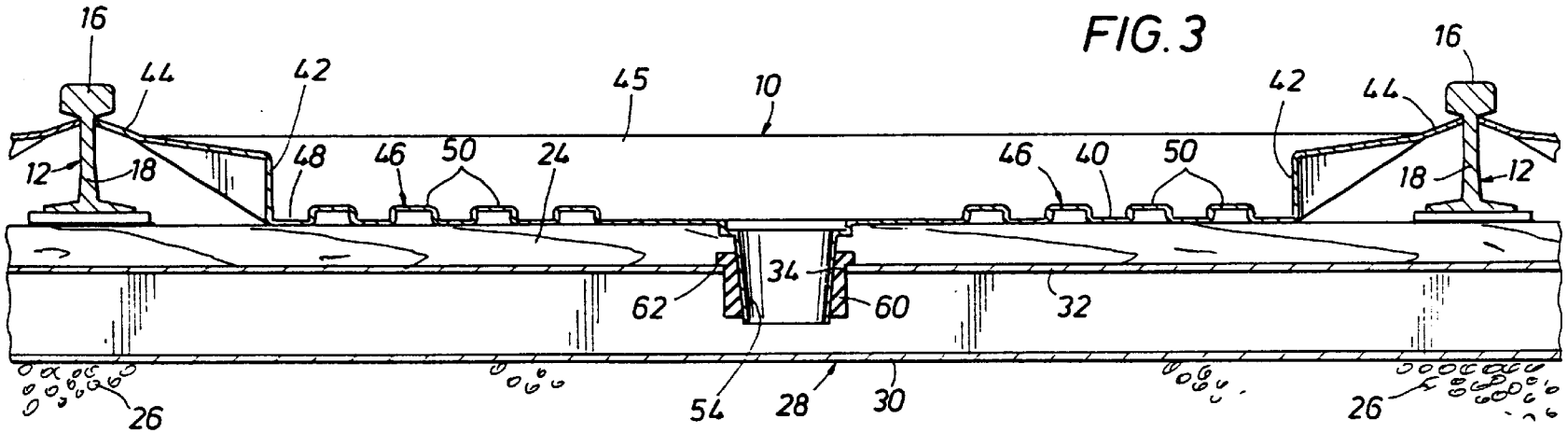
FIG. 3 is a transverse sectional view taken generally along line 3—3 of FIG. 1 and showing an opposite end of the center pan shown in FIG. 2 with a vertical drain pipe received transverse drain conduit.
Figure 4:
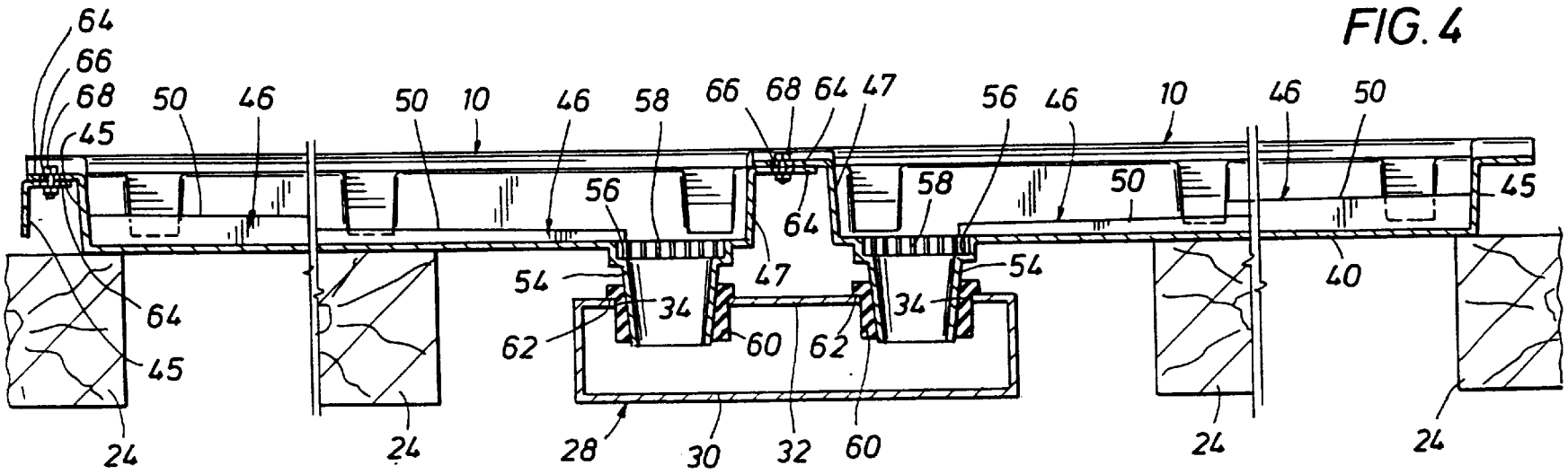
FIG. 4 is an enlarged longitudinal sectional view taken generally along line 4—4 of FIG. 1 and showing a pair of center pans connected in end to end lapping relation and having integral molded drain pipes extending downwardly from the bottom of the center pans into a transverse drain conduit, the intermediate portion of each pan being omitted.
Figure 7:
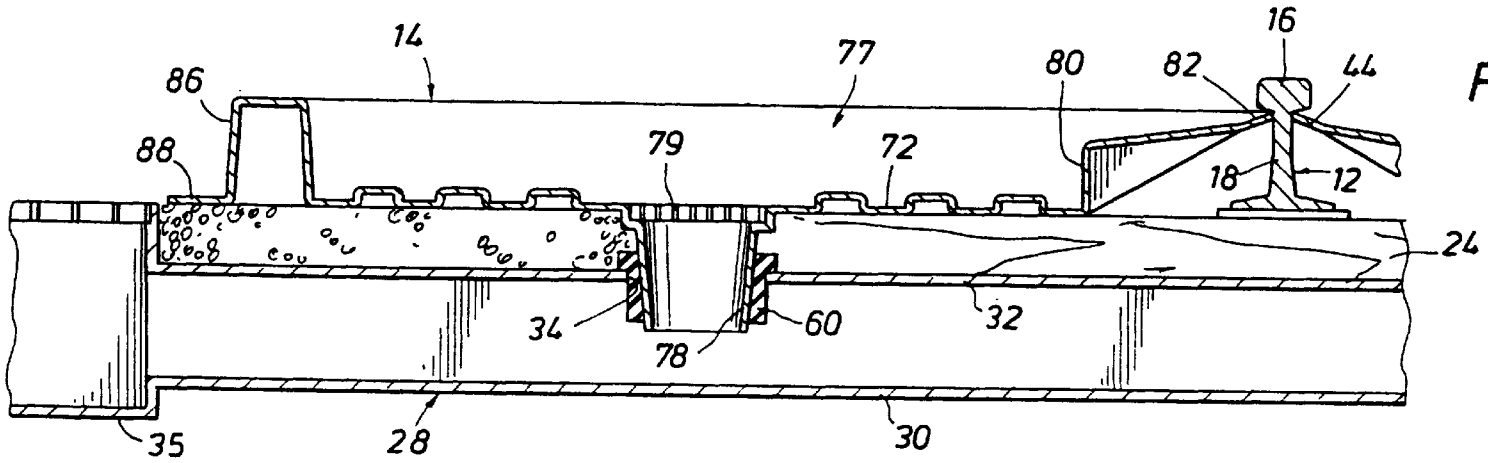
FIG. 7 is a section taken generally along line 7—7 of FIG. 1 and shows the lower drain end of the panel shown in FIG. 6.

For the collection of liquid spillage from pans 10 and 14, an enclosed transverse drain conduit generally indicated at 28 in FIGS. 3, 4, and 7 is positioned between a pair of crossties 24 beneath the drainage end of pans 10 and 14 to receive the liquid spillage from pans 10 and 14. Conduit 28 is of a rectangular cross section having a sloping lower wall 30 and an upper wall 32. Upper wall 32 has an opening 34 for each of pans 10 and 14 to receive the liquid spillage from pans 10 and 14. The extending lower sloping end of transverse drain conduit 28 is connected to a catch basin 35 having a longitudinal drain pipe 36 which extends to a collection facility or container (not shown). If desired, catch basin 35 may be omitted with drain pipe 36 connected directly to an end of drain conduit 28.

Center Pan

Figure 2:
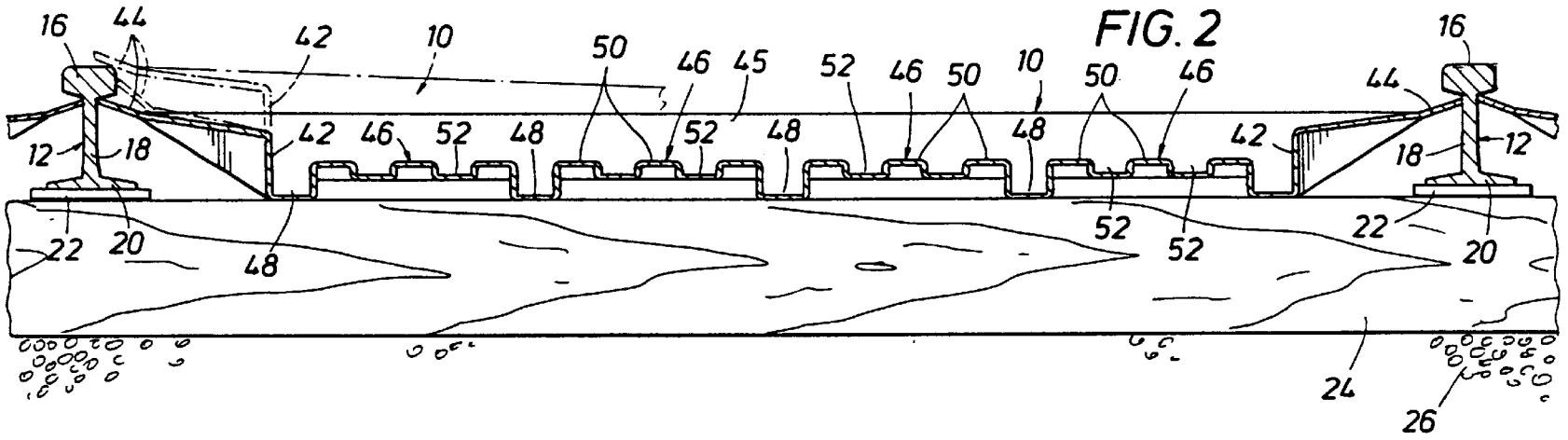
FIG. 2 is a transverse sectional view taken generally along line 2—2 of FIG. 1 and showing one end of a molded center plastic pan installed on the railroad track between the rails.

Each center pan 10 of a molded plastic construction is resilient and includes a bottom 40, a pair of opposed sides 42, and a flexible resilient upper side flange or lip 44 extending laterally outwardly from each side 42. Pan bottom 40 is supported on the upper surface of crossties 24 and has a plurality of molded ribs to provide flow channels for pan 10 and to reinforce pan 10. As shown particularly in FIGS. 2–4, raised rib sections 46 at the upper end 45 of center pan 10 as shown in FIG. 2 slope downwardly to the lower opposed end 47 of pan 10 for the drainage of liquid from upper end 45 to lower end 47. Main flow channels 48 along bottom 40 are provided adjacent raised rib sections 46. Rib sections 46 have ribs or corrugations 50 defining shallow flow channels 52 therebetween. Rib sections 46 for pan 10 having a length of fifteen (15) feet have a slope of between about one (1) and (2) inches from upper end 45 to lower end 47. Flow channels 48 as shown in FIG. 2 adjacent upper end 45 are deep and are shallow adjacent lower end 47 as shown in FIG. 3. Thus, the depth of flow channels 48 progressively decreases from end 45 to end 47. Flow channels 52 remain at a constant depth between ends 45 and 47. Flow channels 48 and 52 are effective in the drainage of solid particles, such as sand, from pan 10. Each molded center pan 10 has an integral downwardly extending drain pipe 54 defining an inset annular shoulder 56 to receive in supporting relation a metal grate 58. Drain pipe 54 tapers in a downward direction and is flexible to facilitate fitting within a vertically aligned opening 34 in transverse drain conduit 28.

To provide a fluid tight fitting between vertical drain pipe or tube 54 and transverse drain conduit 28, an elastomeric sealing sleeve 60 is mounted within opening 34 to receive in sealing relation the lower end of vertical drain pipe 54. Sleeve 60 has an annular shoulder 62 that fits about opening 34 and contacts in sealing relation the upper surface of to upper wall 32 of transverse drain conduit 28. The resilience of sleeve 60 and tapered drain pipe 54 provide an effective sealing relation.

In the installed position, resilient side flanges or lips 44 are positioned in sealing relation against vertical web 18 beneath head 16 of the adjacent rail 12 generally at the juncture of vertical web 18 with head 16. No additional separate sealing elements are required between center pan 10 and rails 12. As shown in FIG. 4, each end 45, 47 has an extending upper end flange 64 which laps an adjacent flange 64 of an adjacent center pan 10. Aligned elongate slots 66 are provided in lapping flanges 64 and fasteners 68 having resilient washers fit within aligned slots 66 and are tightened to hold flanges 64 together at ends 45 and 47. Slots 66 permit limited temperature expansion and contraction of adjacent center pans 10 of about one (1) inch.

Installation of Center Pan

Center pans 10 may be easily installed between rails 12 in a minimum of time. Transverse drain conduit 28 with sleeves 60 within openings 34 is positioned between a pair of crossties 24 with one crosstie 24 removed to provide adequate space for transverse drain conduit 28. A preferred installation method as shown partially in FIG. 2 in broken lines comprises the positioning of one resilient side flange 44 beneath the head 16 of an adjacent rail 12 with pan 10 inclined upwardly at about a thirty (30) degree angle to the adjacent rail 12. Vertical drain pipe 54 is initially aligned vertically with an associated opening 34 and sealing sleeve 60. Then, the center pan 10 is pushed downwardly with the bottom 40 of pan 10 supported on the upper surface of the crossties 24 and pipe 54 received within resilient sleeve 60 in sealing relation. In this position, the opposed resilient side flange 44 is in contact with the upper surface of head 16 of the other rail 12 as shown in broken lines in FIG. 2 and is forced upwardly by the upper surface of head 16. Next, the opposed resilient side flange 44 is forced downwardly past head 16 by a workman with a suitable tool where it snaps outwardly into sealing engagement with vertical web 18 generally at the juncture of vertical web 18 with head 16. Elongate slots 66 in lapping end flanges 64 of adjacent center pans 10 as shown in FIG. 4 are aligned and fasteners 68, such as suitable nut and bolt combinations with resilient washers, are installed to connect adjacent center pans 10 together in end to end relation. Another method of installing center pan 10 comprises the aligning of drain pipe 54 with sleeve 60 and the pushing or forcing of center pan 10 downwardly onto crossties 24 between rails 12 without inclining center pan 10 so that both side flanges 44 contact the upper surface of adjacent heads 16 and are held thereon. Both resilient side flanges 44 may then be forced beneath heads 16 by a workman with a suitable tool for snapping of side flanges 44 into sealing position beneath heads 16.

Side Pans

Figure 6:
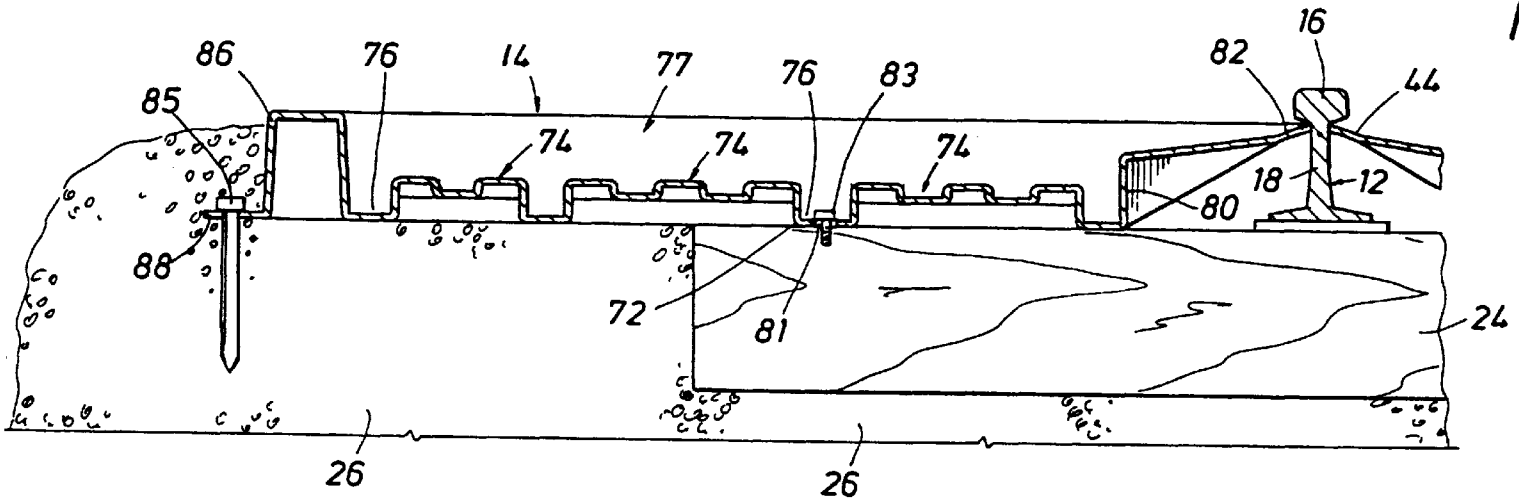
FIG. 6 a section taken generally along line 6—6 of FIG. 1 and showing an upper end of panel.

Side pans 14 shown in FIGS. 6 and 7 are installed after center pans 10 are installed. Each side pan 14 has a bottom 72 and raised rib sections 74. Main flow channels 76 are provided between raised rib sections 74 which slope downwardly from an upper end 77 shown in FIG. 6 to a lower end shown in FIG. 7. An integral drain tube or pipe 78 extends downwardly from bottom 72 for fitting within an elastomeric sealing sleeve 60 in a manner similar to outer pan 10. Grate 79 is supported on drain pipe 78.

An inner side 80 has an extending side flange 82 which fits beneath head 16 in sealing relation generally at the juncture of head 16 and vertical web 18. Drain tube or pipe 78 is positioned for urging side flange 82 into sealing relation with head 16 at the lower end of side pan 14 when drain pipe 78 is received within sealing sleeve 60. Also, bottom 72 has elongate slots 81 receiving lag screws 83 and washers which are secured to the crossties 24. An outer channel-shaped side 86 of side pan 14 has an extending lower flange 88 covered with ballast to assist in maintaining side pan 14 in sealing position against head 16 of the adjacent rail 12.

Each side pan 14 has an upper end flange at each end thereof which is adapted to be positioned and secured in lapping relation to a mating end flange on an adjacent side pan 14 in a manner similar to lapping flanges 64 secured by fasteners 68 as shown in FIG. 4 for center pan 10. Side pans 14 are arranged in transversely aligned position with center panel 10. For installation, resilient side flange 82 is pushed manually tightly against the junction of head 16 and vertical web 18 of adjacent rail 12 with drain pipe 78 aligned vertically with seal 60. Then, downwardly extending drain pipe 78 is lowered within elastomeric sealing sleeve 60 in transverse drain conduit 28. Ballast is then positioned over extending flange 88 and lag screws 83 with washers are inserted in the crossties through suitable elongate slots 81 in bottom 72 of side pan 14. The lag screws 83 are received within a relatively small elongated slot so that limited expansion and contraction of side panel 14 less than about one (1) inch is provided. In some instances, lag screws 83 may be omitted. Spikes 85 are provided for flange 88 and are of a length of about eight (8) inches for extending within ballast 26 for securement of side pans 14.

The arrangement of the rib sections in center panel 10 and side panel 14 provides longitudinal flow channels for the fluid and also solid particles carried by the fluid. Sand is oftentimes deposited into pans 10 and 14 and the arrangement of the longitudinally extending flow channels permits the sand to drain easily into the end drain tube. Heretofore, particularly for flat pans, sand has tended to deposit in various locations of the flat pans. The molded plastic pans 10 and 14 formed preferably of polyethylene provides a substantial resilience and flexibility. Vertical drain pipes which are molded with the pans fit within resilient sleeves in the transverse drain conduit and this permits the track to move relative to the transverse conduit. The limited flexure or movement of the drain pans relative to the transverse drain conduit is important since the operation of a train on the rails causes a vertical pumping action which may be transmitted to the drain pans and cause some movement of the drain pans. As a result of the elastomeric sleeves and the resilient drain pipes received therein, movement of the drain pans and the track is not transmitted to the enclosed lower transverse drain conduit and a substantially liquid tight seal is maintained between the pans and the rails as well as the transverse drain conduit. While the drain conduit has been illustrated in the drawings as positioned at an end of the drain pans, it is apparent that the downward extending drain tube or pipe may be positioned at other locations such as the center of the drain pan, for example. Further, in some instances, it may be desirable to have a single transverse drain conduit for each row of pans. As the plastic material from which the pans are molded, such as high density polyethylene, may be of a thickness of around ¼ inch, the drain pans may be of a relatively long length, such as fifteen (15) feet in length and yet be lightweight. This would permit the easy stacking of vertical pans and side pans for shipment or for storage. Other moldable materials may be suitable for the drain pans such as fiberglass.

Where a single transverse drain conduit is utilized for adjacent transverse pairs of side and center pans arranged in end to end relation as shown in the drawings, it may be desirable to remove a crosstie to permit a relatively wide transverse drain conduit to fit beneath the pans between a pair of adjacent crossties. It is desirable that the pans for installation and transport not be undesirably flexible and the ribbed construction provides reinforcement against bending or flexure particularly in a transverse direction. Likewise, the ends and sidewalls of the pans provide resistance against undue bending or flexure of the pans.

Figure 8:
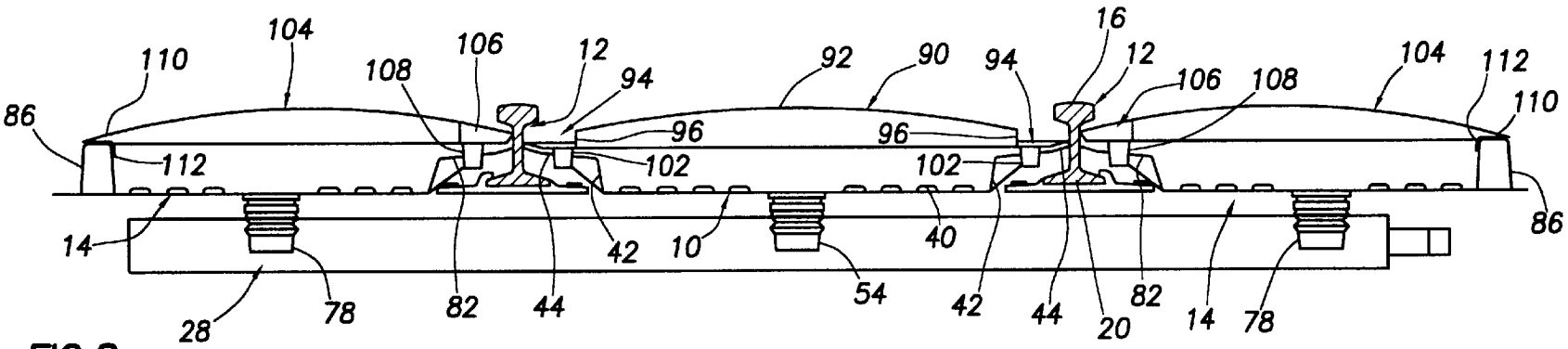
FIG. 8 is a cross sectional view of another embodiment in which removable resilient covers are positioned over the side and center pans with drain spouts in side flanges of the covers extending through aligned openings in the pans for drainage into the ballast.
Figure 9:
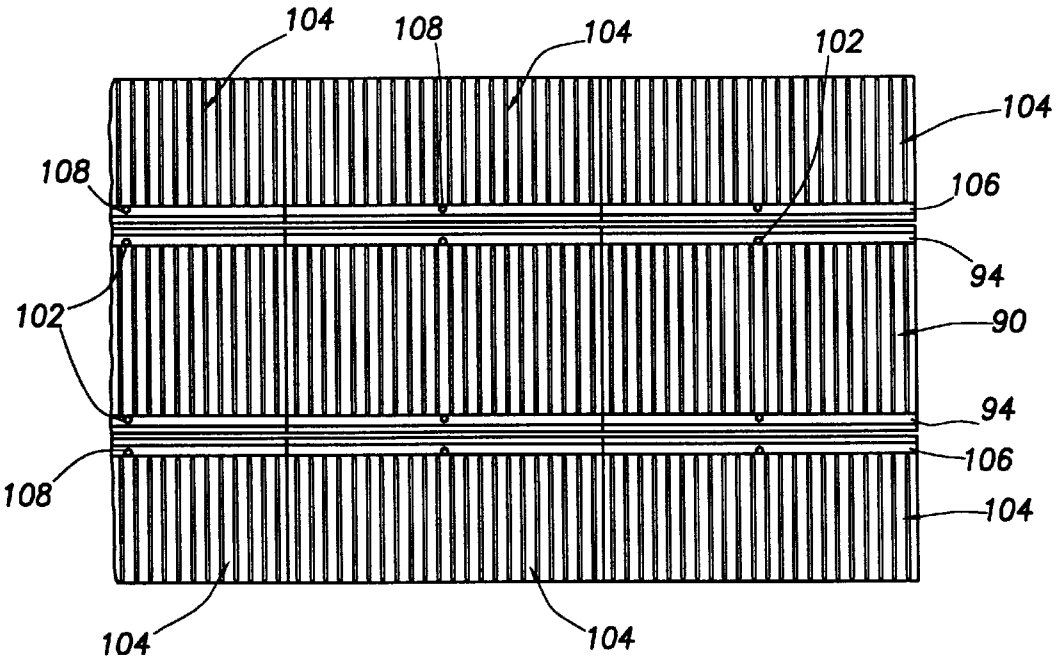
FIG. 9 is plan view of the embodiment shown in FIG. 8.
Figure 10:
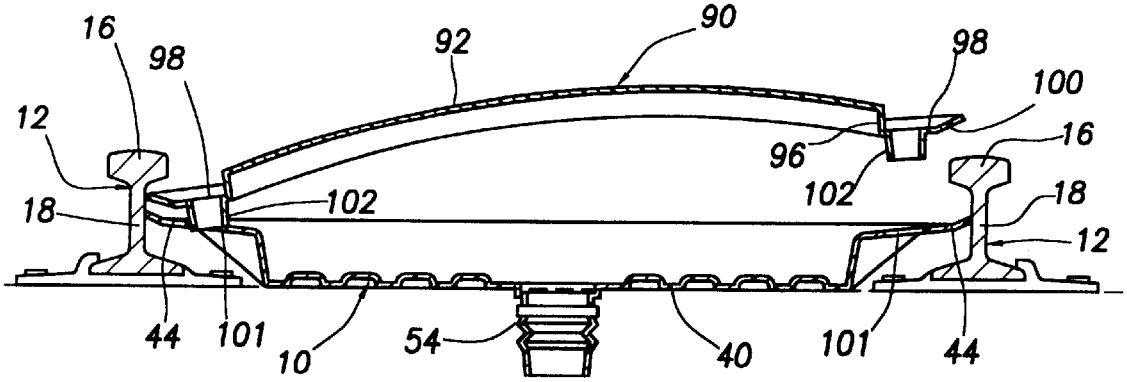
FIG. 10 is a sectional view illustrating installation of the cover for the center pans.

Embodiment of FIGS. 8–10

An embodiment shown in FIGS. 8–10 is directed to a removable cover or lid generally indicated at 90 for fitting over lower center pan 10. Center pan 10 is identical to center pan 10 in the embodiment of FIGS. 1–7 to include a bottom 40, a pair of opposed sides 42 and a flexible resilient upper side flange or lip 44 extending laterally outwardly from each side 42. For installation of center pan 10, one side flange 44 is preferably positioned beneath head 16 of one rail 12 and the other opposed side flange 44 is forced downwardly past head 16 of the other rail 12 snapping beneath head 16 against vertical web 18.

Center cover or lid 90 has an upper arcuate body 92 and a trough generally indicated at 94 along each side thereof defining a fluid flow passage. Trough 94 is defined by a downwardly extending generally vertical side 96, a bottom 98, and an upwardly extending outer flange 100 inclined outwardly for fitting beneath head 16 of rail 12. Bottom 98 contacts and is supported on side flange 44 of center pan 10. A drain spout 102 extends downwardly from bottom 98 and is mounted at a location about ½ the length of trough 94. Trough 94 slopes downwardly from each end of cover 90 to spout 102. Side flange 44 of the subjacent center pan 10 has an opening 101 to receive spout 102. Adjacent lids or covers 10 are arranged in end to end relation and may have mating lapping end flanges for minimizing liquid drainage thereat into the lower closed center pan 10.

Rain water drains from opposed ends of cover 90 downwardly to spouts 102 for discharge through lower flange 44 into the ballast between the crossties. Since covers 90 are formed of a resilient material, such as high density polyethylene, lids 90 may be removed from center pan 10 by forcing flange 100 on one trough 34 inwardly for clearing head 16 of rail 12 thereby permitting the removal of covers 92 so that access to center pan 10 is provided as is desired for loading and unloading railway tank cars and fueling locomotives on rails 12 over center pans 10. Rain water easily flows along troughs 90 for discharge from spouts 102 into the ballast adjacent the ends of troughs 90.

Side pans 14 are shown in FIGS. 8 and 9 and side covers 104 are shown for side pans 14. Side pans 14 have channel-shaped sides 86 and side flanges 82. Covers 104 have a trough 106 on one side adjacent rail 12 with a spout 108 extending downwardly therefrom. The other side 110 is supported on channel 86. A lip 112 fits against the side of channel-shaped side 86 to urge inner side flanges of covers 104 into engagement with adjacent rail 12. Drain pipes 78 on outer pans 14 and drain pipe 54 on center pan 10 extend within transverse drain conduit 28.

Figure 11:
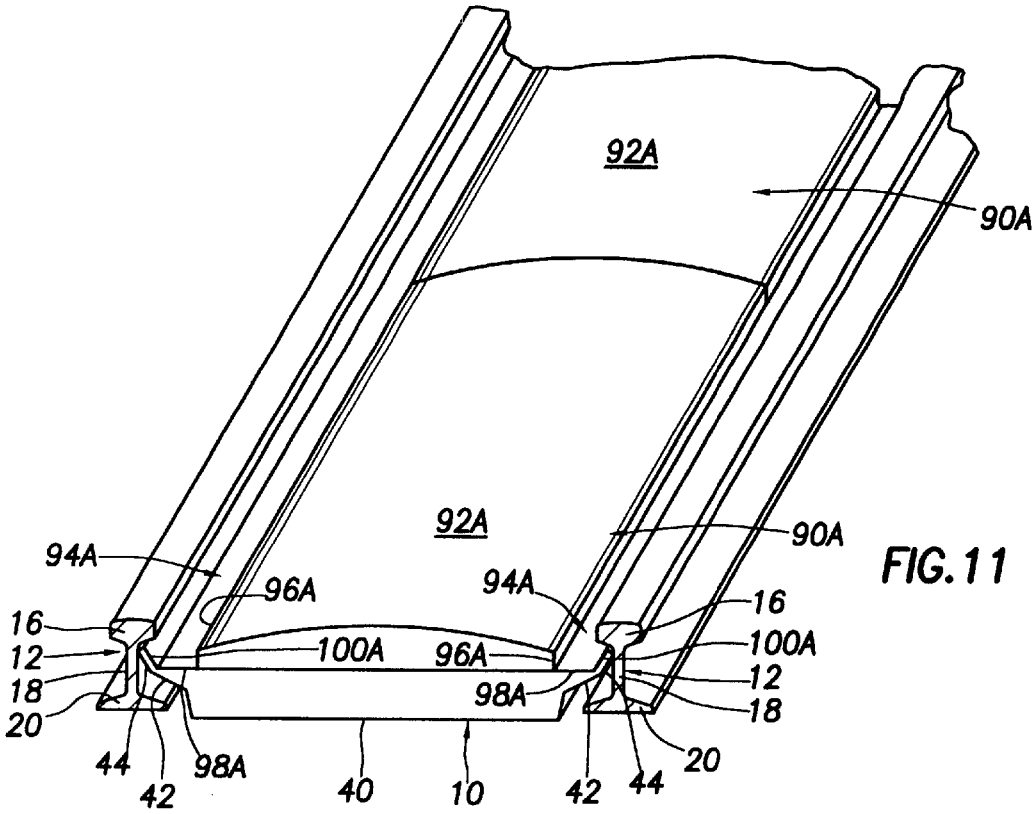
FIG. 11 is a perspective of another embodiment in which a removable cover without spouts is positioned over the center pan and provides a flow channel along each side of the cover for fluid flow into the ballast, the cover being mounted for sliding movement for opening the lower center pan.

Modification of FIG. 11

A modified lid or cover 90A is shown in FIG. 11 for fitting over a subjacent center pan 10. Cover 90A has an upper arcuate body 92A and a trough generally indicated at 94A along each side thereof to form a fluid flow passage. Trough 94A has an inner side 96A, a bottom 98A, and an upwardly extending outer flange 100A inclined outwardly for fitting beneath head 16 of rail 12.

To open center pans 10, particularly for loading and unloading tank cars or fueling locomotives, covers 90A may be removed from center pan 10 by sliding along flanges 44 of center pan 10. Covers 90A may be positioned on the crossties after removal from pans 10 to permit drainage from railway cars or locomotives directly into center pans 10. If desired, lids 90A may be removed by forcing lips 100A from beneath head 10 of rail 12 since cover 90A is formed of a resilient material such as high density polyethylene. Sides 94A are provided with a desired slope for adequate drainage of fluids along troughs 94A. Handles may be provided on covers 90A, if desired, to assist in installation and removal of covers 90A.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A drain pan structure for causing run-off of a liquid or light solids from rail cars supported on rails and crossties; said pan structure comprising:

a drain pan member for fitting between the rails formed of a molded plastic material and having an integrally molded downwardly extending drain pipe;

an elongate transverse drain conduit for fitting between a pair of adjacent crossties below said pan member and having an upper surface spaced below said pan member;

an opening in said transverse drain conduit in alignment with said drain pipe; and resilient means within said opening receiving said drain pipe to permit limited transverse movement between said pan member and said transverse drain conduit.

2. A drain pan structure as set forth in claim 1 wherein said resilient means comprises an elastomeric sleeve positioned within said opening about said drain pipe for sealing thereabout and to permit limited flexure of said drain pan member.

3. A drain pan structure as set forth in claim 2 wherein said drain pipe has an upwardly facing shoulder adjacent the bottom of said pan member and a grate is positioned on said shoulder over said drain pipe.

4. A drain pan structure as set forth in claim 1 where said pan member has a plurality of longitudinally extending ribs along the bottom of said pan member defining a plurality of flow channels for liquid and solid materials.

5. A system for collecting liquid spillage at rail facilities having a pair of rails supported on crossties; said system including a plurality of center pans positioned end to end between the rails and a plurality of side pans positioned in end to end relation along the sides of the rails, said center pans and said side pans supported on said crossties; each of said pans having a downwardly extending integral tubular drain and being molded to shape from a lightweight plastic material; said center pans each having a pair of upwardly extending resilient side flanges engaging the rails beneath the heads thereof in a sealing relation; and an enclosed transverse drain conduit positioned between a pair of crossties beneath the pans; said transverse conduit having an upper opening for each of said pans and said downwardly extending tubular drains are received within the upper openings in said transverse drains for the liquid spillage.

6. The system as set forth in claim 5 wherein a resilient annular sealing member is positioned about each of said upper openings in said transverse drain conduit, and receives a tubular drain for sealing about the tubular drain.

7. In combination with a pair of rails supported on crossties and ballast of a railroad track; an improved pan collection system for collecting run-off of a liquid or light solids spilled while unloading or loading a rail car supported on said rails and crossties; said pan collection system comprising:

a plurality of sets of drain pan members arranged end-to-end and supported by said crossties and ballast, each of said sets of pan members including a center pan member positioned between said rails and outside pan members positioned respectively on opposite sides of said rails and said center pan member;

an enclosed transverse elongate drain conduit positioned between a pair of adjacent crossties below said pan members and having an upper surface spaced vertically from said pan members;

said center pan member formed of a resilient material and having upwardly directed side flanges for fitting beneath the upper heads of said pair of rails for positioning said center pan between the rails;

a pair of spaced openings in said center pan member and said transverse drain conduit;

a drain pipe mounted between said pair of openings to provide a flow passage from said pan members to said enclosed transverse drain conduit; and resilient means adjacent said drain pipe to permit limited movement of said pan members relative to said transverse drain conduit.

8. The combination as set forth in claim 7 wherein said resilient means comprises an elastomeric seal positioned about said drain pipe and fitting within said vertically aligned opening in said enclosed transverse drain conduit to provide a generally fluid tight seal thereat.

9. The combination as set forth in claim 7 wherein said center pan member is formed of a one piece homogeneous resilient material.

10. The combination as set forth in claim 1 wherein said center pan member is formed of a molded plastic material and said drain pipe is integrally formed with said center pan member.

11. The combination as set forth in claim 10 wherein said center pan member is formed of polyethylene.

12. The combination as set forth in claim 7 wherein said center pan has a plurality of longitudinally extending parallel ribs therein defining flow channels between adjacent ribs for directing the flow of fluid toward said opening in said pan members.

13. The combination as set forth in claim 12 wherein said center pan member has an upper surface sloping downwardly from one end of said center pan member to the other opposite end thereof, and said opening in said center pan member is positioned in said opposite end.

14. The combination as set forth in claim 7 wherein adjacent center pans are positioned in end to end relation to said first mentioned center pan, each of said center pans having an upper end flange extending in a lapping relation to an adjacent end flange on a contiguous center pan, and fasteners are secured to said lapping end flanges to permit limited longitudinal movement between adjacent center pans resulting from ambient temperature changes.

15. A system for collecting liquid spillage at rail facilities having a pair of rails supported on crossties; said system comprising:

a center pan supported on said crossties positioned between the rails and formed of a resilient material, said center pan having a downwardly extending integral tubular drain and a pair of integral upwardly extending sides engaging the rails beneath the heads; and an upper cover for each of said center pans formed of a resilient material and having a pair of opposed integral sides defining longitudinally extending channels for fluid flow, said sides of said upper cover supported on said sides of said center pan for relative movement to remove said cover and open said center pan for the collection of liquid spillage.

16. The system for collecting liquid spillage as defined in claim 15 wherein said sides of said cover have upwardly extending flanges for engaging the rails beneath the heads thereof.

17. The system for collecting liquid spillage as defined in claim 15 further comprising:

a downwardly extending spout in each of said sides of said cover; and an opening in each said side of said center pan aligned with said spout to permit fluid flow therethrough.

18. The system for collecting liquid spillage as defined in claim 15 further comprising a plurality of center pans positioned in end to end relation between the rails, each center pan having a pair of opposed sides; and a plurality of covers positioned over said center pans, each of said covers having a pair of opposed sides supported on said sides of said center pans and engaging the rails beneath the heads thereof.

19. The system for collecting liquid spillage as defined in claim 18 wherein said covers are mounted on said center pans for relative sliding movement for removal of said covers from said center pans to open said pans for collection of liquid spillage.

20. The system of collecting liquid spillage as defined in claim 15 wherein said center pan has a plurality of longitudinally extending ribs to provide flow channels, said ribs defining the bottom of said center pan and engaging the crossties for being supported thereon; said center pan and said cover thereon sloping downwardly toward an end of said center pan for fluid flow along said sides for discharge from the end of the center pan.

21. The system for collecting liquid spillage as defined in claim 15 wherein a side pan is positioned on said crossties outwardly of each of rail; and an upper cover is provided on each of said side pans.

22. The system for collecting liquid spillage as defined in claim 21 further comprising:

a downwardly extending spout in each of said covers for said side pans positioned along the adjacent rail.

23. In combination with a pair of rails supported on crossties and ballast of a railroad track; an improved pan collection system for collecting run-off of a liquid or light solids spilled while unloading or loading a rail car supported on said rails and crossties; said pan collection system comprising:

a plurality of sets of drain pan members arranged end-to-end and supported by said crossties and ballast, each of said sets of pan members including a center pan member positioned between said rails and outside pan members positioned respectively on opposite sides of said rails and said center pan member;

a transverse elongate drain conduit positioned between a pair of adjacent crossties below said pan members and having an upper surface spaced vertically from said pan members;

said center pan member formed of a resilient material and having upwardly directed side flanges engaging the rails at beneath the upper heads of said pair of rails for positioning said center pan between the rails;

a pair of aligned openings in said center pan member and said transverse drain conduit; and a drain pipe mounted between said pair of openings to provide a flow passage from said center pan member to said enclosed transverse drain conduit;

said center pan having a plurality of longitudinally extending ribs for reinforcing said center pan and to provide flow channels, said ribs defining the bottom of said center pan and engaging the crossties for being supported thereon.

24. The combination as defined in claim 23 wherein said plurality of longitudinally extending ribs define a plurality of deep flow channels and a plurality of shallow flow channels between adjacent deep flow channels.

25. The combination as defined in claim 24 wherein the bottom of said center pan slopes progressively downwardly to said drain pipe for fluid flow to said drain pipe.

26. The combination as defined in claim 24 wherein said drain pipe, is positioned adjacent one end of said center pan and the bottom of said center pan slopes progressively downward to said drain pipe from the opposite end of said center pan.

27. The combination as defined in claim 23 further comprising:

an upper cover for said center pan having a pair of opposed resilient side flanges forming a channel for fluid flow, said side flanges of said upper cover supported on said side flanges of said center pan; said upper cover being removably mounted on said side flanges of said center pan.

28. The combination as defined in claim 27, further comprising:

a downwardly extending spout in each of said flanges of said cover; and an opening in each said side flange of said center pan aligned with said spout to permit fluid flow therethrough.

29. The combination as defined in claim 27 wherein said cover is mounted on said center pan for relatively sliding movement for removal of said cover from said center pan to open said center pan for collection of liquid spillage.

30. The combination as defined in claim 27 wherein said resilient side flanges of said upper cover are upwardly directed for fitting beneath the upper heads of said pair of rails for fitting over said side ranges of said center pan.

31. The combination as defined in claim 23, further comprising:

a pair of center pans positioned between the rails in end to end relation and said transverse drain conduit extends beneath said pair of center pans; and a drain pipe is mounted between each center pan and the transverse drain conduit for the flow of liquids, said center pans having said ribs sloping downwardly to the associated drain pipes for the flow of liquids to said drain pipe.

32. The combination as set forth in claim 31 wherein said plurality of longitudinally extending ribs defines the bottom of each center pan and forms a plurality of deep flow channels and a plurality of shallow flow channels between the deep flow channels.

* * * * *